US005732667A

United States Patent [19]

Sakurai

[11] Patent Number: 5,732,667

[45] Date of Patent: Mar. 31, 1998

[54] ENGINE WATER PUMP DRIVE

[75] Inventor: Kenichi Sakurai, Iwata, Japan

[73] Assignee: Yamaha Hatsudoki Kabushiki Kaisha, Iwata, Japan

[21] Appl. No.: 684,541

[22] Filed: Jul. 19, 1996

[30] Foreign Application Priority Data

Jul. 31, 1995 [JP] Japan ..... 7-195070

[51] Int. Cl.[6] ..... F01P 5/10

[52] U.S. Cl. ..... 123/41.44; 123/90.31

[58] Field of Search ..... 123/41.44, 198 R, 123/90.27, 90.31

[56] References Cited

U.S. PATENT DOCUMENTS 5,113,807 5/1992 Kobayashi ..... 123/41.44

*Primary Examiner*—Noah P. Kamen

*Attorney, Agent, or Firm*—Knobbe, Martens, Olson & Bear LLP

[57] ABSTRACT

An improved water pump drive arrangement for an internal combustion engine, having an intermediate shaft. The water pump is driven from one of the flexible transmitters of the camshaft drive and is located in such an arrangement so as to function as an idler for the flexible transmitter and also to permit the water pump to be mounted at the end of the engine, although the flexible transmitters are spaced from the engine end.

8 Claims, 6 Drawing Sheets

ENGINE WATER PUMP DRIVE

BACKGROUND OF THE INVENTION

This invention relates to an internal combustion engine and more particularly to an improved engine water pump and drive arrangement.

Modern internal combustion engines and particularly those applied to motor vehicles have become quite complex in nature. Not only is the basic engine more complicated due to the use of single or twin overhead cams and multiple valves but the engine is also called upon to drive increasing numbers of auxiliaries and accessories. Thus, the basic engine as well as its output driving arrangements have become quite complicated. This adds significantly to not only the volume or size of the engine and its cost but also to difficulties in servicing the engine.

It has been acknowledged that some advantages can be obtained in an engine by adding an intermediate shaft which is driven off of the engine crankshaft and which can be utilized as an additional source of power for such accessories and auxiliaries for the engine. An example of such an arrangement is shown in U.S. Pat. No. 5,113,807, entitled "Cooling System for Engine," issued in the name of Manabu Kobayashi on May 19, 1992, which patent is assigned to the Assignee hereof. In that patent, the intermediate shaft actually forms an output shaft for the engine, in addition to driving other components such as the twin overhead camshaft. This arrangement has a number of advantages and does provide a more compact engine construction.

In the arrangement as shown in that patent, the water pump is driven from the same flexible transmitter that drives a cam driving shaft from the engine crankshaft. This cam driving shaft is mounted in the cylinder head and drives the twin overhead cams through another flexible transmitter drive. Although this arrangement has a number of advantages, the driving mechanism for the water pump and the water pump location may not be optimum for all installations.

It is, therefore, a principal object of this invention to provide an improved water pump and water pump drive arrangement for an internal combustion engine.

In the aforenoted patent, the water pump is actually located at a point that is spaced from one end of the engine and which is disposed on a side of the engine. This side mounting has advantages, particularly when the engine is intended to be mounted in a transverse relationship to the engine compartment of an associated motor vehicle. This facilitates the connections to the heat exchanging radiator which extends parallel to the longitudinal direction of the engine crankshaft.

However, there are certain machining disadvantages with such an arrangement in that the bearings for the water pump require a relatively long tool in order to accomplish their machining.

It is, therefore, a still further object of this invention to provide an improved water pump location for an engine wherein the machining for the components of the water pump can be facilitated.

As noted previously, the water pump in U.S. Pat. No. 5,113,807 is driven by the same flexible transmitter that drives the cam driving shaft. This simplifies the overall construction. However, in the arrangement shown in that patent, the water pump is driven on the inside of the flexible transmitter, and as a result, the transmitter tensioner must be placed close to the drive for the water pump. This requires displacement of the components away from the main body of the engine. This somewhat complicates the positioning of the components and also makes the engine more bulky.

It is, therefore, a still further object of this invention to provide an improved drive arrangement for an engine water pump.

SUMMARY OF THE INVENTION

A first feature of this invention is adapted to be embodied in an internal combustion engine that is comprised of a cylinder block that has a cylinder head affixed to one end thereof in closing relationship to the cylinder bores in the cylinder block. At least one overhead camshaft is journaled for rotation about a first axis in the cylinder head for operating valves therein. A crankcase closes the other end of the cylinder block and contains a crankshaft that is rotatably journaled about a second axis which is parallel to the first axis and which is driven by pistons mounted in the cylinder block cylinder bore. An intermediate shaft is journaled for rotation about a third axis that is parallel to the first and second axes and which is disposed on one side of the engine. A drive arrangement is provided for driving the intermediate shaft from the crankshaft. A cam driving shaft is journaled for rotation at one side of the cylinder block about a fourth axis that is parallel to the first, second and third axes and which is spaced from the third axis and which is in proximity to the cylinder head. A first flexible transmitter is provided for driving the cam driving shaft from the intermediate shaft at a point spaced inwardly from one end of the engine. A second flexible transmitter is provided for driving the camshaft from the cam driving shaft. A water pump is drivingly connected to one of the flexible transmitters and is located at the one end of the engine for circulating water through cooling jackets of the cylinder block and cylinder head.

Another feature of the invention is also adapted to be embodied in an internal combustion engine that is comprised of a cylinder block having a number of cylinder bores with a cylinder head closing one end of the cylinder block and the cylinder bores. At least one overhead camshaft is journaled for rotation about a first axis in the cylinder head for operating the valves therein. A crankcase closes the other end of the cylinder block and contains a crankshaft that is rotatably journaled about a second axis which is parallel to the first axis. An intermediate shaft is journaled for rotation about a third axis parallel to the first and second axes and disposed at one side of the cylinder block. Means including a flexible transmitter drive is provided for driving the intermediate shaft from the crankshaft and the camshaft from the intermediate shaft. A water pump is provided at one side of the engine and has a drive element that is engaged with the outer peripheral surface of the flexible transmitter for maintaining the flexible transmitter in driving engagement with the shafts which it joins and for driving the water pump. A chain tensioner is disposed on the other side of the flexible transmitter for maintaining the tension in the flexible transmitter.

DETAILED DESCRIPTION OF THE PREFERRED EMBODIMENTS OF THE INVENTION

Figure 1:
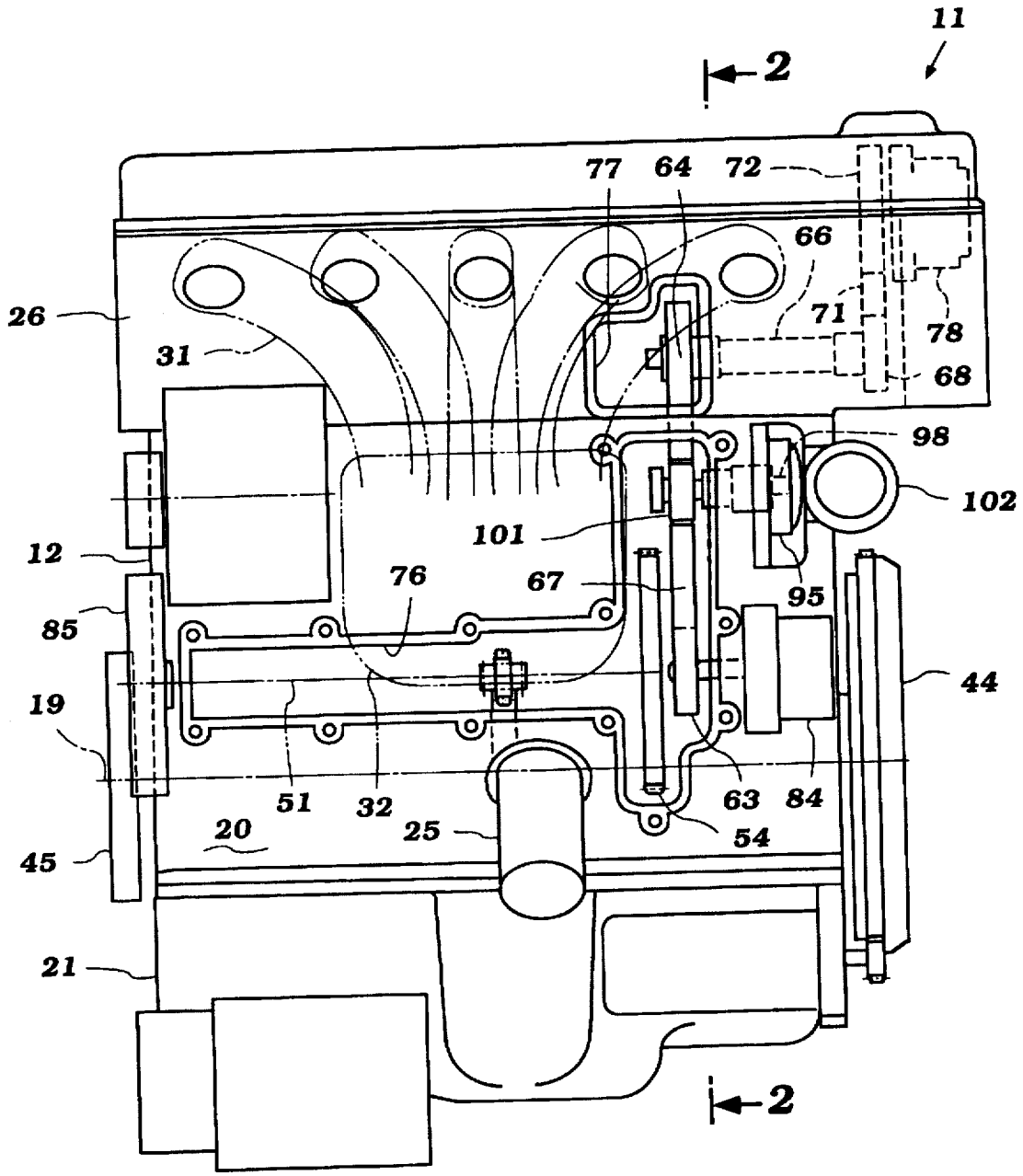
FIG. 1 is a front view of a transversely-mounted engine constructed in accordance with an embodiment of the invention with certain portions shown in phantom.
Figure 2:
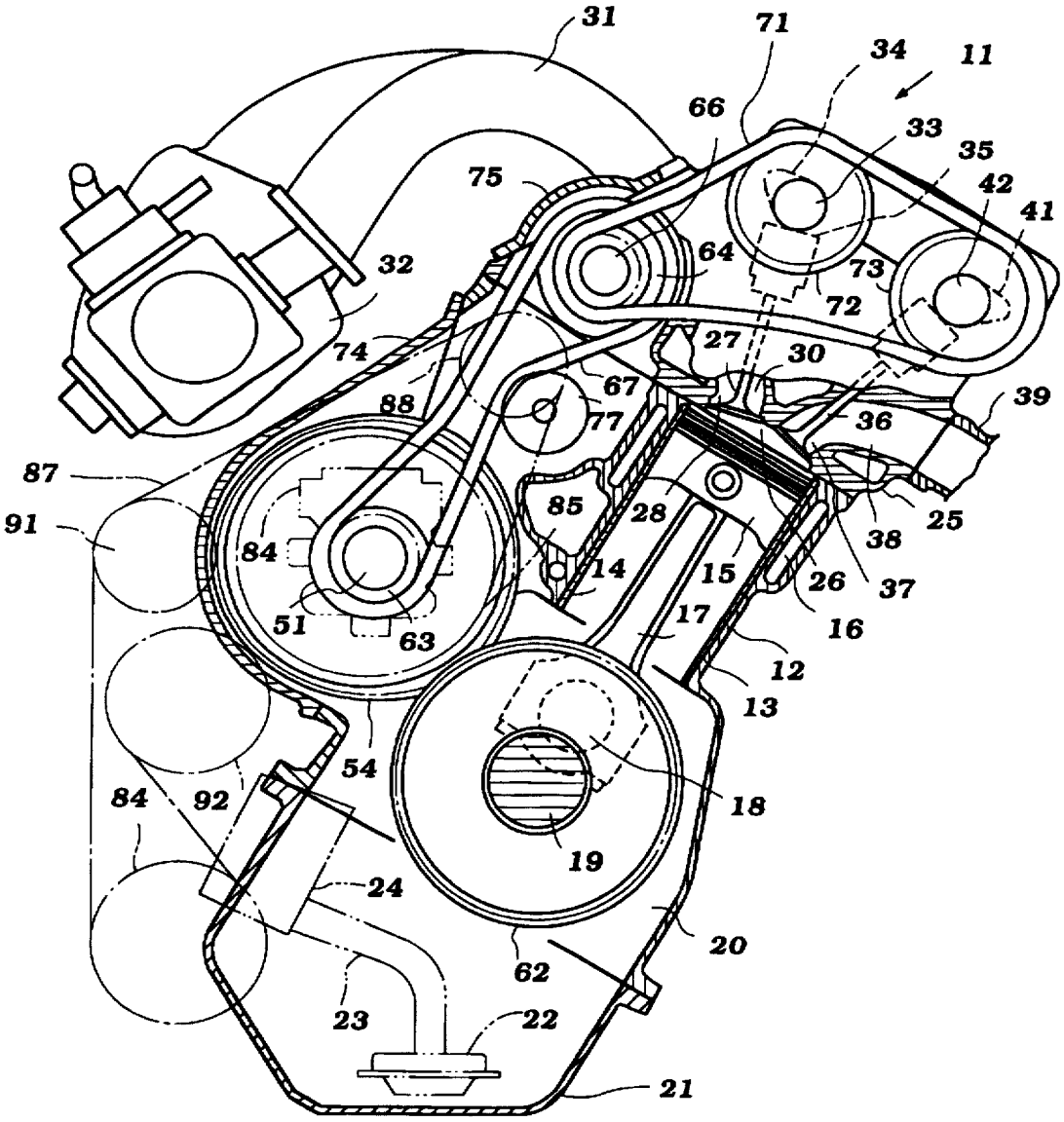
FIG. 2 is a cross-sectional view taken along line 2—2 of FIG. 1 and illustrates various internal components and a portion of the accessory drive arrangement for the engine in phantom.

Referring now to the drawings and initially to FIGS. 1 and 2, an internal combustion engine constructed in accordance with an embodiment of the invention is indicated generally by the reference numeral 11. In the illustrated embodiment, the engine 11 is depicted as being of the five-cylinder, in-line, four-stroke type though it is to be understood that the invention may also be practiced in conjunction with engines of other configurations. The engine 11 is configured so as to facilitate its use as a propulsion unit for motor vehicles such as an automobile. Particularly the engine 11 is configured for use in a transverse positioning in the engine compartment, although its use is not so limited. However the compact construction of the engine facilitates such applications even though the engine 11 is capable of having more cylinders than normally possible in such transverse engine orientations.

The engine 11 is comprised of a cylinder block 12 which may be formed of a lightweight material such as cast aluminum alloy and includes cylindrical openings in which are press-fitted or otherwise formed sleeves 13 that define cylinder bores 14 in which pistons 15 reciprocate. The cylinder bore axes define a plane that is inclined rearwardly from vertical. As such, the cylinder block 12 slants rearwardly.

The engine 11 is water cooled. For this reason, a plurality of water jackets 16 are disposed adjacent to and above the cylinder bores 14 so as to cool the engine 11. Water is supplied to the water jackets 16 through a cooling system that will be discussed in detail later. The pistons 15 are pivotally connected to the small ends of respective connecting rods 17, whose big ends are rotatably journaled about the throw 18 of a crankshaft 19. The crankshaft 19 is rotatably journaled by any suitable means within a crankcase 20. The construction of the crankshaft 19 will be discussed in detail later.

The crankcase 20 is defined by the lower end of the cylinder block 12 and a lower crankcase member 21 which serves the oil pan for the engine 12 and is affixed to the cylinder block 12 by any suitable means. A strainer 22 is disposed within the lower end of the oil pan 21 and communicates through a conduit 23 with an oil pump 24 which pumps lubricating oil through an oil filter 25 and throughout the engine 11, as is well known in the art.

A cylinder head is indicated by the reference numeral 26 and is affixed to the top of the cylinder block 12 in a known manner. The cylinder head 26 has individual recesses 27 that cooperate with the cylinder bores 14 and pistons 15 to define the engine combustion chambers. Intake valves 28 are slidably supported in the cylinder head 26 and control intake ports 29 that cooperate with the inner ends of intake passages 30 formed in the cylinder head 26. The outer ends of the intake passages 30 terminate at an intake manifold 31, which delivers a supply of atmospheric air and fuel from an induction and charge former 32 to the combustion chambers 27. The induction and charge former 32 mixes a supply of atmospheric air with fuel from a fuel tank (not shown) at a suitable ratio for combustion. The amount of air-fuel charge delivered to the combustion chambers 27 by the induction and charge former 32 is regulated by a throttle valve (not shown).

An overhead intake camshaft 33 is rotatably journaled about a first axis, namely its own longitudinal axis, within the cylinder head 26 and includes lobe portions 34 for operating the intake valves 28 through tappets 35. The intake camshaft 33 is driven in a manner which will be described in detail later.

Exhaust valves 36 are slidably supported in the cylinder head 26 and control the flow of exhaust gases from the combustion chambers 27 through exhaust ports 37 and into exhaust passages 38. The exhaust passages 38 cooperate with an exhaust manifold 39 and exhaust system (not shown) for discharging the exhaust gases from the engine 11 to the atmosphere and for silencing these discharged gases. The exhaust valves 36 are operated on by the lobes 41 of an overhead exhaust camshaft 42 through tappets 43. The exhaust camshaft 42 is journaled within the cylinder head 26 about an axis parallel to the first axes of the intake camshaft 33 and driven in a manner to be described in detail later.

The crankshaft 19 will now be described with additional reference to FIG. 3. The crankshaft 19 is rotatably journaled within the crankcase 20 and rotates about a second axis, namely, its own longitudinal axis that is parallel to the first axis. This rotation drives a flywheel 44 that is affixed to the rear end of the crankshaft 19 and whose inertia assists in the smooth operation of the engine 11 at low engine speeds. This end of the engine 11 is refereed to as the "rear end" even though the engine 11 is disposed transversely in the illustrated embodiment. In a longitudinal arrangement this end would normally be the rear end. The flywheel 44 is also associated with a transmission (not shown) for driving a vehicle powered by the engine 11. A crankshaft damper 45 is affixed to the front end of the crankshaft 19 by a bolt 46 and reduces the torsional vibrations of the crankshaft 19 about the second axis. These vibrations are caused by the downward motions of the pistons 15 and connecting rods 17 during the expansion strokes for the respective cylinder bores 14.

The crankshaft 19 is provided with five throws 18 which cooperate with the respective cylinder bores 14. The throws 18 are connected to the central shaft 47 of the crankshaft 19 by cheek portions 48 which are associated in pairs with each of the throws 18. The throws 18 are offset from the longitudinal axis of the crankshaft 19, and thus their associated pistons 15 and connecting rods 17 exert outwardly directed forces at each of their associated central shafts 47 when the crankshaft 19 is rotating. These forces are balanced by counterweights that are indicated by the reference numeral 49 and are formed on the ends of the cheeks 48 opposite of the ends to which the throws 18 are affixed. It should be noted, however, that no counterweights 49 are associated with the cheeks of the second cylinder bore 14 from the flywheel 44, and that only a single counterweight 49 is associated with the cheeks 48 of the cylinder bore 14 that is adjacent to the damper 45. Thus, the crankshaft 19 is not completely balanced.

It is well known in the art that additional balancing means are also necessary in order to adequately balance engines that have a certain number of cylinders, such as three or five cylinders. A balancer shaft is frequently employed as the balancing means and is usually positioned underneath the crankshaft and inside the crankcase member. This location for the balancer shaft, however, increases the overall height of the engine and may cause packaging problems for the vehicle which is driven by the engine. It is desirable therefore to utilize a balancer shaft arrangement where the balancer shaft is positioned in a manner that does not increase the height of the engine while still providing an overall compact assembly. This is accomplished by disposing the balancer shaft forwardly of the engine.

Figure 3:
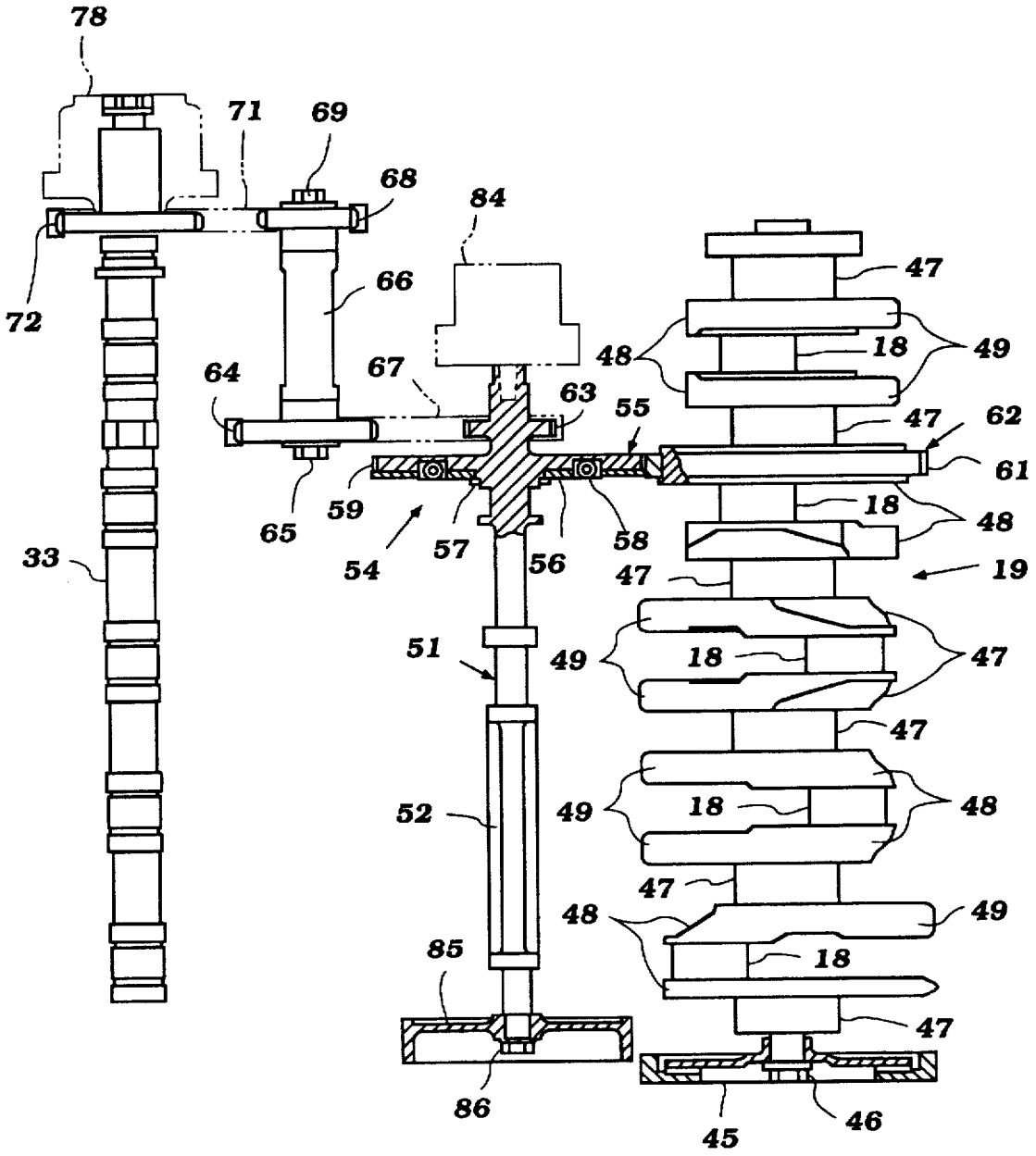
FIG. 3 is a development view of the accessory drive arrangement with portions of the crankshaft and intermediate shaft shown in cross section.

With continued reference primarily to FIGS. 2 and 3, an intermediate shaft is utilized as a balancer shaft and is indicated by the reference numeral 51. This shaft 51 is rotatably journaled about a third axis, namely, its longitudinal axis, within the engine cylinder block 12. This third axis is parallel to and offset forwardly and upwardly from the second axis of the crankshaft 19 and, along with the second axis, defines a plane that is disposed forwardly of and at some acute angle to the plane defined by the cylinder bores 14. The intermediate shaft 51 includes a front end eccentric balancing mass 52 which serves as the means by which any engine vibration that is not balanced by counterweights 49 is balanced. The operation of the eccentric mass 52 will be discussed later.

The intermediate shaft 51 is driven from the crankshaft 19 by means of a direct gear drive 54 and includes a gear assembly 55 that is integrally formed with the intermediate shaft 51. A sub-gear 56 is held in association with the gear 55 by a retainer 57 and has limited relative rotation to the gear 55 about the second axis. This rotation is controlled by a biasing spring 58 which acts between the gear 55 and sub-gear 56, both of which are additionally provided with teeth 59 in one-to-one correspondence which extend about their outer circumference.

The springs 58 tend to rotate the sub-gear 56 such that its teeth 59 can shift in alignment with those of the gear 55 to take up any lash in the direct gear drive 54. As will be seen below, this misalignment acts as an anti-backlash coupling which improves and silences the operation of the intermediate shaft 51.

The teeth 59 of the balancer gear assembly 55 mesh with and are driven by the teeth 61 of a crankshaft drive gear 62 that comprises one of the cheeks 48 of the crankshaft 19 that is associated with the throw 18 of the second cylinder bore 14 and thus spaced inwardly from the ends of the crankshaft 19.

It has been noted that this throw 18 has no counterweights. The gear 55, however, has a cutout portion (not shown) so that it too is unbalanced. This unbalanced mass thus balances for the unbalance of the driving throw 18 of the crankshaft 19. Thus, with additional reference now to FIG. 4, the crankshaft 19 which rotates counterclockwise, as indicated by the arrow a, drives the intermediate shaft 51 in the clockwise direction indicated by the arrow b. This clockwise rotation of the intermediate shaft 51 causes the eccentric mass 52 to generate forces that are equal to the remaining unbalanced forces generated by the crankshaft 19, but act in the opposite direction. These forces thus cancel each other out, meaning that the intermediate shaft 51 effectively balances the engine 11.

With conventional engines it is the practice to utilize the engine to drive a number of accessories which may be required for engine operation or which may be utilized with the vehicle powered by the engine. These accessories are typically driven off of one end of the engine, and thus tend to increase the overall length of the engine. This increase in length is especially undesirable for those associated motor vehicles in which the engine is mounted transversely across the vehicle. It is desirable therefore to utilize an engine configuration where the accessories are driven by a means associated with the engine that in no way adds to the length of the engine. This is accomplished by additionally utilizing the intermediate shaft 51 to drive the accessories in a manner which allows for the mounting of the accessories to the engine 11 at locations that in no way add to the length of the engine 11.

With reference primarily to FIG. 3, the intermediate shaft 51 includes a camshaft drive sprocket 63 that is integrally formed with the intermediate shaft 51 adjacent to the balancer gear 55 and is thus disposed inwardly relative to the ends of the crankshaft 19. The drive sprocket 63 drives a further sprocket 64 that is affixed by a bolt 65 to one end of a cam driving shaft 66 inwardly from the torsional damper 45 through a first flexible transmitter drive 67.

The cam driving shaft 66 is rotatably journaled within the cylinder head 26 about a fourth axis, namely its own longitudinal axis, that is parallel to the first, second and third axes. A further sprocket 68 is affixed by a bolt 69 to the other end of the cam driving shaft 66 and drives a second flexible transmitter device 71, which in turn drives sprockets 72 and 73 that are associated with the overhead camshafts 33 and 42, respectively. Thus, the overhead camshafts 33 and 42 are driven by a camshaft drive arrangement that is disposed entirely forwardly of the engine 12 in a compact manner that does not add to the length of the engine 11. This arrangement is covered by covers 74 and 75, which are affixed by any suitable means to the engine block 12 and cylinder head 26, respectively and cover the openings 76 and 77 (FIG. 1).

It should be noted at this time that the camshaft sprockets 72 and 73 drive the camshafts 33 and 42 through a variable valve timing mechanism 78, shown in phantom in FIGS. 1 and 3. This variable valve timing mechanism 78 allows the cam timing to be modified so as to provide optimum engine performance under a variety of engine running conditions.

As is well known, the camshafts 33 and 42 are normally driven at one half crankshaft speed. Usually this is accomplished by means of a two-to-one gear or sprocket reduction between the crankshaft 19 and the camshafts 33 and 42. Such large reductions in a single drive tend to cause the gears and/or sprockets associated with the camshafts 33 and 42 to be unduly large. In accordance with a feature of this invention, a portion of the speed reduction occurs between the sprockets 63 and 64 and the remainder of the reduction between the sprockets 68 and 72 and 73 on the camshafts 33 and 42 such that the two combined ratios give the desired one-half speed reduction.

Figure 4:
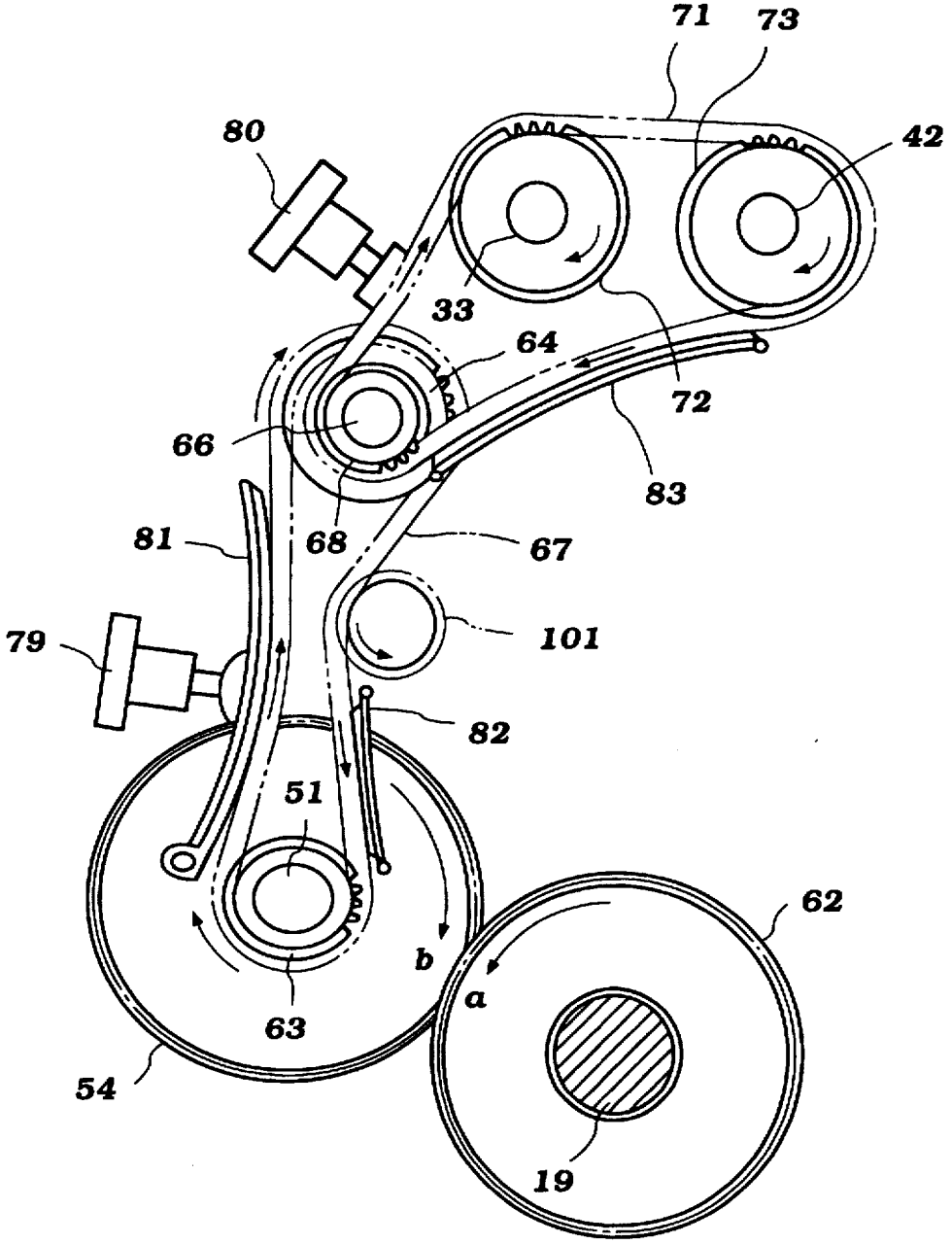
FIG. 4 is a side elevational view of the accessory drive arrangement.

It is also seen in FIG. 4 that a pair of adjustable, flexible transmitter tensioners 79 and 80 are associated with the first and second flexible transmitter drives 67 and 71, respectively. The first tensioner 79 is associated with the first flexible transmitter drive 67 and operates a tension rail 81 that is pivotally connected at one end to the engine block 12 on the forward side of the transmitter drive 67. A guide rail 82 is also associated with the transmitter drive 67 on the side opposite of the tension rail 81. The second tensioner 80 acts directly against the outer periphery of the second flexible transmitter drive 71 above the cam driving shaft 66. A guide rail 83 is also associated with the second flexible transmitter drive 71.

The intermediate shaft 51 is also used to drive a plurality of additional engine and other accessories. A power steering pump is indicated by the reference numeral 84 and is directly driven off of the rearward end of the intermediate shaft 51. A second accessory drive mechanism is composed of a pulley 85 that is affixed to the forward end of the intermediate shaft 51 by a bolt 86. The pulley 85 drives a serpentine belt 87 which transmits drive to a number of pulleys associated with various engine and other accessories.

An alternator 88 is affixed to the lower front face of the engine block 12, forward of the plane defined by the cylinder bores 14 and above the plane defined by the second and third axes, and driven off of the belt 87, as is an air compressor 89 that is affixed to the lower forward portion of the crankcase member 21 beneath the plane defined by the second and third axes. An idler pulley 91 is associated with the belt 87 above the air compressor 89 and utilized to provide clearance for the belt 87 from the engine 11. A tension pulley 92 is also affixed to the engine 11 between the air compressor 89 and idler 91, and maintains proper torsion in the belt 87.

Figure 5:
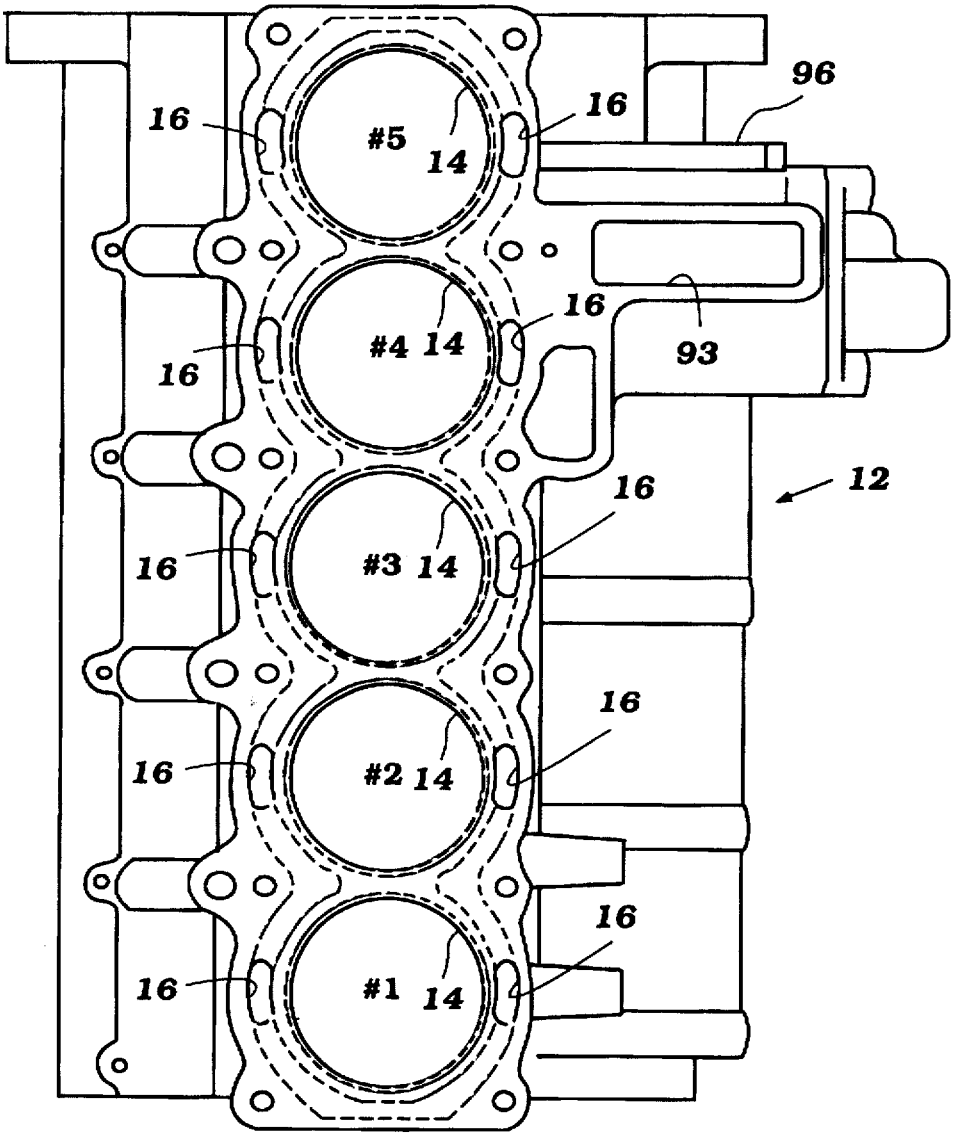
FIG. 5 is a top plan view of a cylinder block utilized in conjunction with the accessory drive arrangement of FIGS. 1–4.

FIG. 5 is a top plan view of the engine block 12 used in association with the drive arrangement 54. A vertical tunnel 93 is disposed forwardly of and spaced between the numbers four and five cylinder bores 14 which are at the rear or flywheel end of the engine 11. The tunnel 93 is in alignment with the camshaft drive sprocket 63 of the intermediate shaft 51 and the first flexible transmitter drive 67 extends through the tunnel 93 for driving the cam driving shaft 66.

The cooling system will now be described with additional reference to FIGS. 5 and 6. The intermediate shaft 51 is used to drive a number of accessories already described and is also used to drive a water pump which comprises a component of the cooling system for the engine 11. This water pump is driven by the intermediate shaft 51 through the first flexible transmitter drive 67. A problem exists, however, in that driving the water pump in the above manner requires that the water pump be mounted to the engine 11 in proximity to the first flexible transmitter drive 67 and may result in the water pump being disposed at a less than optimum location. This can complicate the construction of the water pump and necessitate the use of a relatively long tool in the machining of the water pump.

This invention eliminates these problems by disposing the water pump in proximity to the first flexible transmitter drive 67 in such a manner as to provide an optimum water pump location in terms of accessibility and overall compact assembly while maintaining a simple construction.

Figure 6:
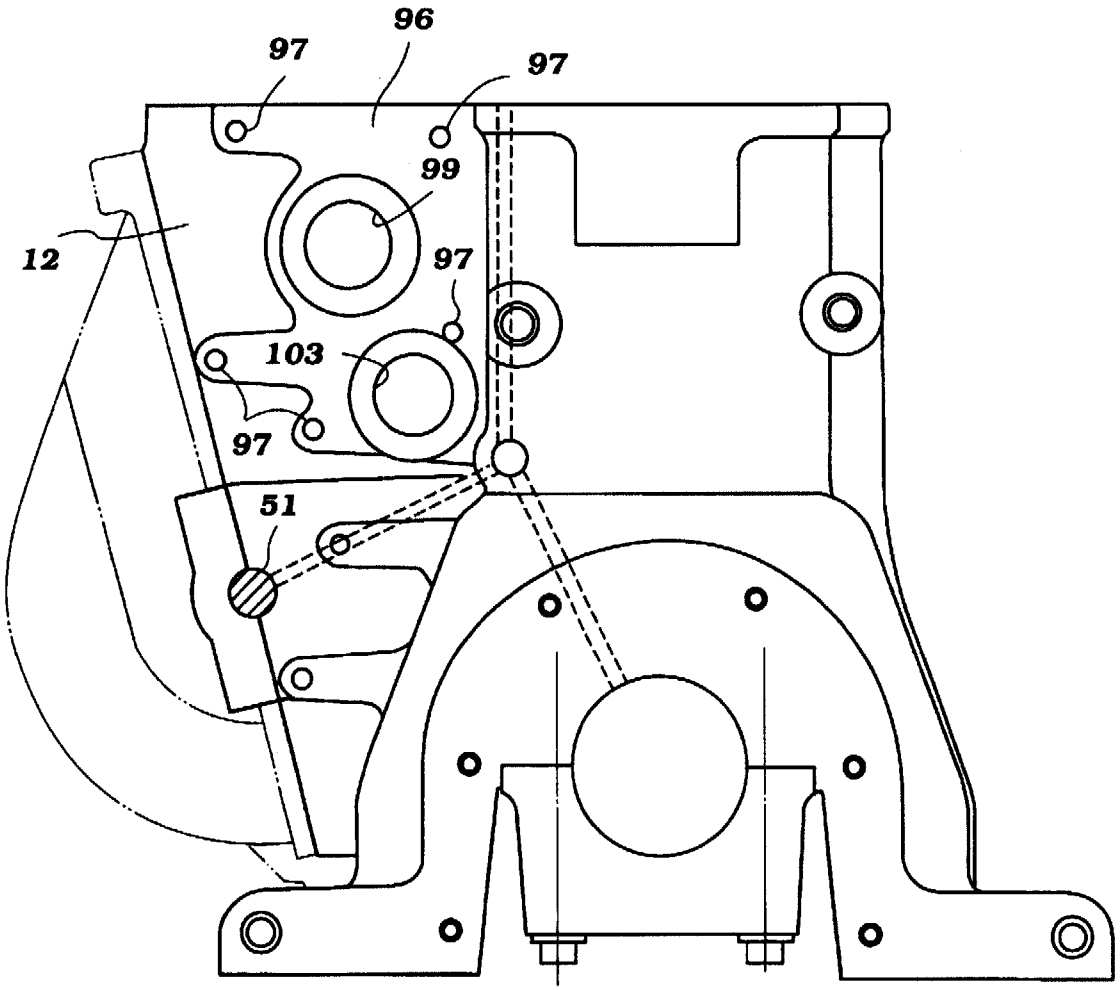
FIG. 6 is a side elevational view of the engine block.

A water pump is indicated by the reference numeral 95 and, as seen in FIG. 6, affixed to a mounting surface 96 formed on the rear longitudinal end of the engine block 12 by bolts 97 such that the water pump 95 is positioned adjacent to the side of the first flexible transmitter drive 67 that is opposite the tensioner 79. The water pump 95 is thus readily accessible but does not increase the overall longitudinal length of the engine 11 since, as seen in FIG. 1, it is spaced inwardly relative to the camshaft driving arrangement 54. Also, a long tool is no longer needed for water pump machining since the mounting of the water pump 95 directly on to the rear surface 96 of the engine block 12 greatly simplifies the construction and therefore machining of the water pump 95.

The water pump 95 is driven by a shaft 98 (FIG. 1) that is rotatably journaled within the engine block 12 and whose outer end extends through an opening 99 in the block 12 for driving the water pump 95. A water pump driving element, namely a sprocket 101, is affixed to the inner end of the shaft 98 in driving engagement with the outer peripheral surface of the first flexible transmitter drive 67. Thus, the water pump 95 is driven off of the intermediate shaft 51 through the first flexible transmitter drive 67. This outer drive location eliminates the need of a tensioner or idler pulley on this side of the transmitter 67.

Cooling water is supplied to the water pump 95 from a radiator (not shown) through a hose (not shown) that terminates at an inlet fitting 102 which delivers the water to the water pump 95. The water pump 95 then pumps the water through a supply tunnel 103 which terminates at the longitudinal end of one of the cooling jackets 16 from where the water readily circulates throughout all of the water jackets 16 in the engine block 12 and cylinder head 26 through connecting channels 104 shown in phantom in FIG. 5. Thus, the water effectively cools the engine block 12 and cylinder head 26 before circulating back to the radiator by any suitable means It should be readily apparent that the above engine provides an arrangement whereby the water pump is of a compact construction that is easily accessible and does not add to the length of the engine. Of course, the foregoing description is that of preferred embodiments of the invention, and various changes and modifications may be made without departing from the spirit and scope of the invention, as defined by the appended claims.

What is claimed is:

1. An internal combustion engine comprised of a cylinder block having a plurality of cylinder bores formed between longitudinal end faces thereof, a cylinder head affixed to one end of said cylinder block and closing one end of said cylinder bores, at least one overhead camshaft journaled for rotation about a first axis in said cylinder head for operating valves therein, a crankcase closing the other end of said cylinder block and containing a crankshaft rotatably journaled about a second axis parallel to said first axis and driven by pistons in said cylinder bores, an intermediate shaft journaled for rotation about a third axis parallel to said first and said second axes and disposed at one side of said cylinder block, a drive arrangement for driving said intermediate shaft from said crankshaft, a cam driving shaft journaled for rotation at said one side of said cylinder block about a fourth axis parallel to said first, second and third axes and spaced from said third axis and in proximity to said cylinder head, a first flexible transmitter for driving said cam driving shaft from said intermediate shaft, a second flexible transmitter for driving said camshaft from said cam driving shaft, and a water pump disposed at one longitudinal end of said cylinder block longitudinally beyond said cylinder bores, said water pump being driven by one of said flexible transmitters.

2. An internal combustion engine comprised of a cylinder block having a plurality of cylinder bores formed therein, a cylinder head affixed to one end of said cylinder block and closing one end of said cylinder bores, at least one overhead camshaft journaled for rotation about a first axis in said cylinder head for operating valves therein, a crankcase closing the other end of said cylinder block and containing a crankshaft rotatably journaled about a second axis parallel to said first axis and driven by pistons in said cylinder bores, an intermediate shaft journaled for rotation about a third axis parallel to said first and said second axes and disposed at one side of said cylinder block, a drive arrangement for driving said intermediate shaft from said crankshaft, a cam driving shaft journaled for rotation at said one side of said cylinder block about a fourth axis parallel to said first, second and third axes and spaced from said third axis and in proximity to said cylinder head, a first flexible transmitter for driving said cam driving shaft from said intermediate shaft, a second flexible transmitter for driving said camshaft from said cam driving shaft, and a water pump disposed at one longitudinal end of said cylinder block and driven by one of said flexible transmitters by engagement with the outer peripheral surface of said one flexible transmitter.

3. An internal combustion engine as set forth in claim 2, wherein the flexible transmitter is the first flexible transmitter.

4. An internal combustion engine as set forth in claim 1, wherein the water pump circulates water through cooling jackets formed in the cylinder head and the cylinder block by delivering water to one longitudinal end of one of said cooling jackets.

5. An internal combustion engine comprised of a cylinder block having a plurality of cylinder bores formed therein, a cylinder head affixed to one end of said cylinder block and closing one end of said cylinder bores, at least one overhead camshaft journaled for rotation about a first axis in said cylinder head for operating valves therein, a crankcase closing the other end of said cylinder block and containing a crankshaft rotatably journaled about a second axis parallel to said first axis and driven by pistons in said cylinder bores, an intermediate shaft journaled for rotation about a third axis parallel to said first and said second axes and disposed at one side of said cylinder block, a drive arrangement for driving said intermediate shaft from said crankshaft, a cam driving shaft journaled for rotation at said one side of said cylinder block about a fourth axis parallel to said first, second and third axes and spaced from said third axis and in proximity to said cylinder head, a first flexible transmitter for driving said cam driving shaft from said intermediate shaft, a second flexible transmitter for driving said camshaft from said cam driving shaft, a water pump disposed at one longitudinal end of said cylinder block and driven by one of said flexible transmitters, said water pump being engaged with the outer peripheral edge of said one flexible transmitter on one side of a pair of shafts drivingly connected by said flexible transmitter, and a flexible transmitter tensioner engaged with said one flexible transmitter on the other side of the shafts drivingly connected by said one flexible transmitter.

6. An internal combustion engine as set forth in claim 5, wherein the one flexible transmitter is the first flexible transmitter.

7. An internal combustion engine as set forth in claim 6, wherein the water pump circulates water through cooling jackets formed in the cylinder head and the cylinder block by delivering water to one longitudinal end of one of said cooling jackets.

8. An internal combustion engine comprised of a cylinder block having a plurality of cylinder bores formed therein, a cylinder head closing one end of said cylinder block, at least one overhead camshaft journaled for rotation about a first axis in said cylinder head for operating valves therein, a crankcase closing the other end of said cylinder block, a crankshaft rotatably journaled about a second axis parallel to said first axis within said crankcase and driven by pistons in said cylinder bores, an intermediate shaft journaled for rotation about a third axis parallel to said first and said second axes and disposed on one side of said cylinder block, means for driving said intermediate shaft and said camshaft from said crankshaft, including at least one flexible transmitter, a water pump having a driving element engaged with the outer peripheral edge of said flexible transmitter on one side of a pair of shafts drivingly connected by said flexible transmitter, and a flexible transmitter tensioner engaged with the flexible transmitter on the other side of the shafts drivingly connected by said flexible transmitter.

* * * * *